US005928749A

United States Patent [19]

Forman

[11] Patent Number: 5,928,749

[45] Date of Patent: Jul. 27, 1999

[54] RESEALABLE PACKAGE, AND APPARATUS FOR AND METHOD OF MAKING SAME

[76] Inventor: Harold M Forman, P.O. Box 60, Boyertown, Pa. 19512

[21] Appl. No.: 08/749,659

[22] Filed: Nov. 15, 1996

Related U.S. Application Data

[ 60] Provisional application No. 60/007,481, Nov. 22, 1995.

[51] Int. Cl.[6] ..... B65D 65/02

[52] U.S. Cl. ..... 428/43; 229/87.01; 229/87.09; 229/87.11; 229/87.12; 229/87.19; 428/42.1; 428/42.2; 428/42.3; 428/194

[58] Field of Search ..... 428/40.1, 43, 42.2, 428/42.3, 42.1, 194, 77, 78, 79; 229/87.01, 87.09, 87.11, 87.12, 87.19, 87.05, 87.08, 87.18

[56] References Cited

U.S. PATENT DOCUMENTS

| | | | |
|---|---|---|---|
| 2,225,694 | 12/1940 | Freeman | 229/87.11 |
| 2,328,688 | 9/1943 | Sheerin | 229/87.09 |
| 2,475,052 | 7/1949 | Rosen | 229/87.09 |
| 2,618,333 | 11/1952 | Judd | 428/40.1 |
| 3,346,105 | 10/1967 | Nye | 428/40.1 |
| 3,551,245 | 12/1970 | Gamberini | 156/260 |
| 3,566,752 | 3/1971 | Dreher | 229/87.05 |

*Primary Examiner*—Nasser Ahmad
*Attorney, Agent, or Firm*—Walter B. Udell

[57] ABSTRACT

The invention provides tape graphics printed on a longitudinally extending strip of packaging film simultaneously with the printing of the rest of the packaging film, the tape graphics strip being subsequently slit away from the rest of the film and applied to the package as part of the sealing tape, thereby eliminating the problem of proper registration of tape graphics when the tape is applied to the package because the tape and the package film are synchronized as each package is fabricated without the accumulation of long term drift between the package film and the tape being applied to it. Since the tape graphics are printed at the same time as the package film, there is no need to have a separate preproduced inventory of customized graphics tape, and the colors of the graphics tape and the rest of the package are perfectly matched. When forming reclosable or easy-opening containers with a tack free flap without graphics, it is no longer necessary to preprocess the pressure sensitive tape to include a tack free flap because the necessary tack free flap can be formed on line with a portion of the package film which has been slit away from the package film and applied to the pressure sensitive tape. Additionally, the packaging provides a hermetic seal and can be provided with a tearstrip package openable feature that discloses whether the package has been previously opened. Moreover, there is no exposed adhesive on either surface of the composite web of packaging material, and it can either be run directly into a packaging apparatus to produce finished packages, or can be spooled for future use. When applying tearstrips to a package, or a reinforcement header strip, or a handle, it is no longer necessary to provide separate materials for the tearstrips, headers, and handles because these materials can be formed directly from the package film itself, thus no longer requiring that separate supplies of these materials be on hand.

17 Claims, 7 Drawing Sheets

OPEN
30
31
32
33
34
35
35A
36
36A
37
39
40
41
42
43
44
45
46
47
48
49
50
51
52
53
54
55
56
57
58
59
60
61
2
3
4

FIG.2
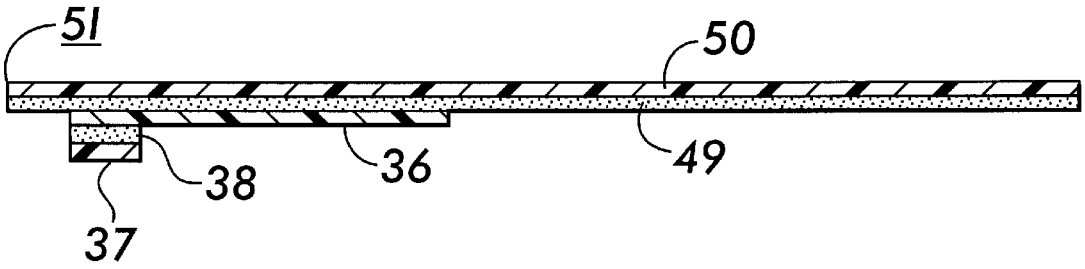
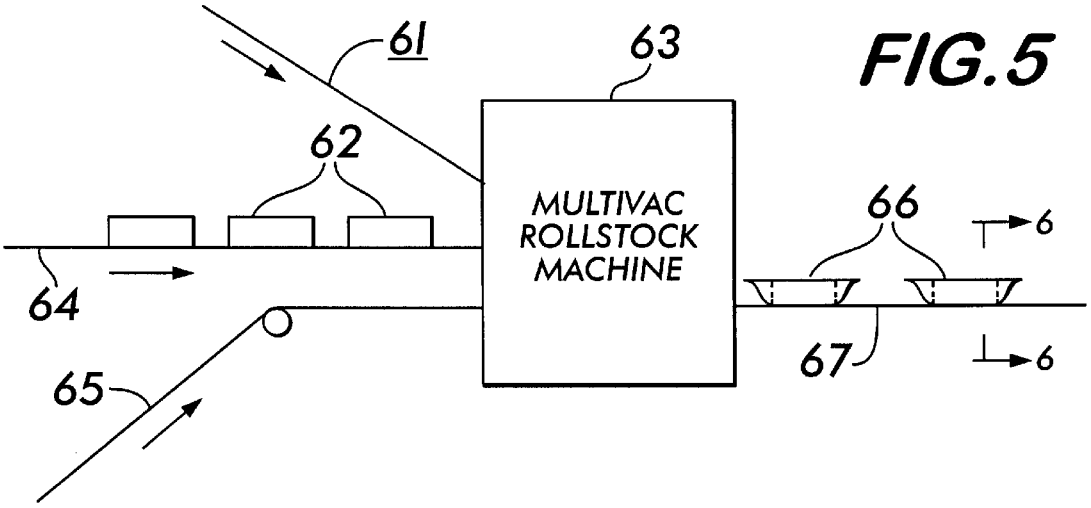
FIG.5
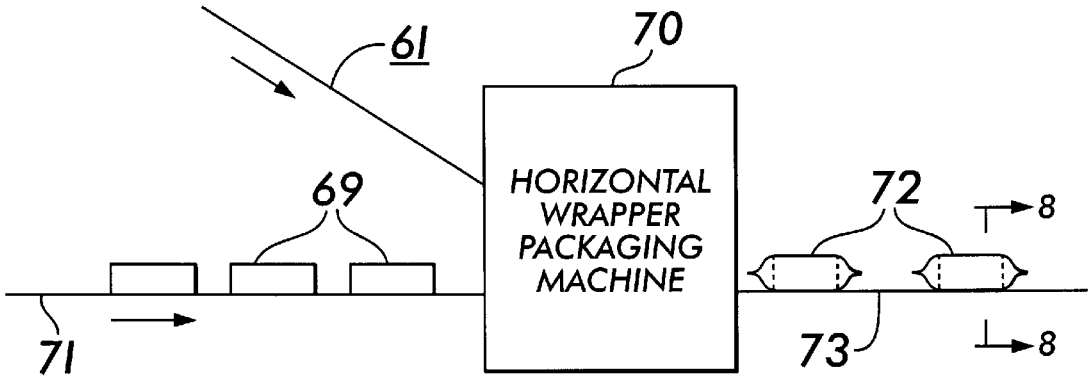
FIG.7

FIG.15
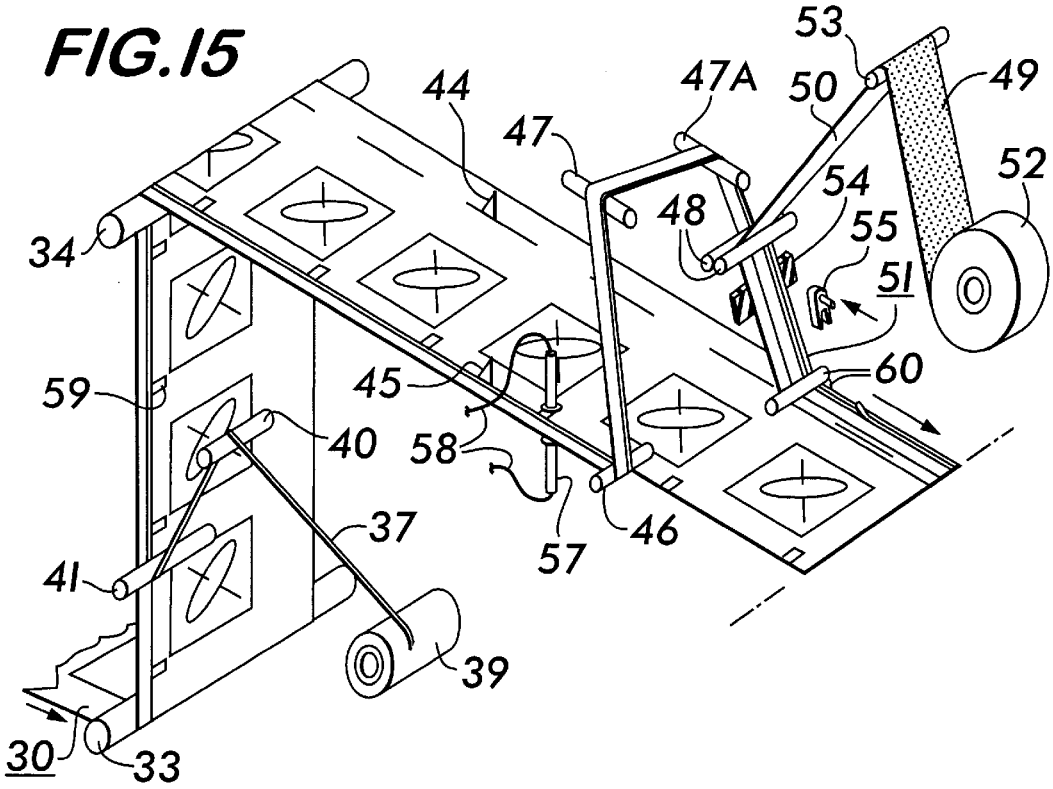
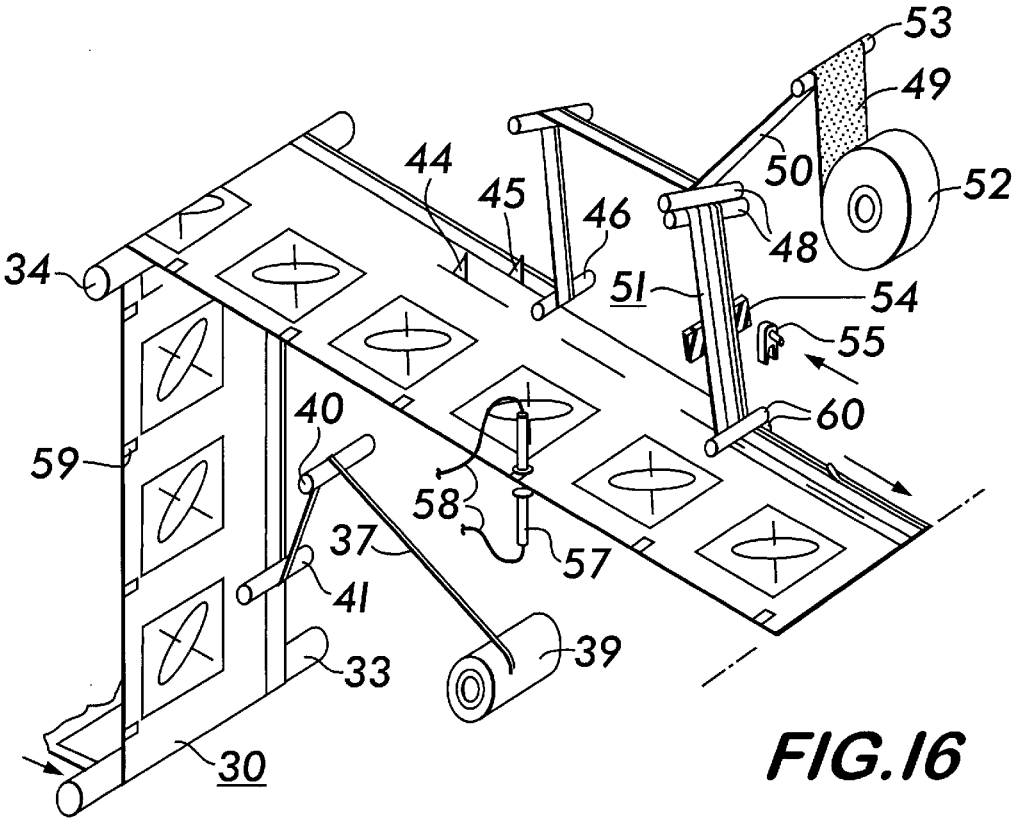
FIG.16

RESEALABLE PACKAGE, AND APPARATUS FOR AND METHOD OF MAKING SAME

RELATED APPLICATION

This application claims the benefit of U.S. Provisional application No. 60/007,481 filed on Nov. 22, 1995.

BACKGROUND OF THE INVENTION

1. Field of the Invention

The invention relates generally to securing one flexible substrate to another, in some cases releasably and in other cases permanently. More particularly, the invention relates to utilizing a first substrate material and forming the second substrate from the first, as for example in the manufacturing of a package or a tape.

2. Related Art

In the past in the manufacture of resealable consumer product packaging, as shown for example in U.S. Pat. No. 4,709,399 to Sanders, a tape is premade from a particular flexible material and is coated with a partially widthwise extending pressure sensitive adhesive to form a tack free flap. The pressure sensitive surface of the premade tape is then applied over a slit in the packaging material to keep the edges of the slit in fixed apposition. This system of making a resealable package suffers from several major drawbacks which severely limit its use. First, it is impossible to preprint graphics on a premade tape and achieve proper registration of the graphics when the tape is applied to the package where one or both of the package film and tape are characterized by any degree of stretch. Second, even if it were possible to achieve proper registration, the economics require the obtaining and storage of substantial customized tape inventories in order to have on hand what is needed to make a production package run. This is very expensive in that substantial capital can be tied up in tape inventory, and if inventories are held too long before use their usable life can be exceeded. Further, the art does not disclose a resealable package which provides evidence that the package has been opened. Moreover, resealable packages made according to the prior art do not provide a hermetic seal.

Additionally, when applying tearstrips to a package, or a reinforcement header strip, or a handle, it has in the past been necessary to provide separate materials for the tearstrips, headers, and handles. This requires that supplies of these materials be on hand, and that apparatus for properly affixing these materials to the package be provided.

SUMMARY OF THE INVENTION

The apparatus and method according to the invention obviate these problems. First, as to the graphics problem, the invention provides tape graphics printed on a longitudinally extending strip of the packaging film simultaneously with the printing of the rest of the packaging film, the tape graphics strip being subsequently slit away from the rest of the film and applied to the package as part of the sealing tape. This eliminates the problem of proper registration of tape graphics when the tape is applied to the package, because the tape and the package film are synchronized as each package is fabricated without the accumulation of long term drift between the package film and the tape being applied to it. Second, since the tape graphics are printed at the same time as the package film, there is no need to have a separate preproduced inventory of customized graphics tape. An additional benefit is that the colors of the graphics tape and the rest of the package can be perfectly matched.

When forming reclosable or easy-opening containers with a tack free flap without graphics, it is no longer necessary to preprocess the pressure sensitive tape to include a tack free flap. The necessary tack free flap can be formed on line with a portion of the package film which has been slit away from the package film and applied to the pressure sensitive tape. Additionally, the packaging according to the invention can be provided with a tearstrip package openable feature that discloses whether the package has been previously opened, and such resealable packages made according to the invention also provide a hermetic package seal. Moreover, there is no exposed adhesive on either surface of the composite web of packaging material, and it can either be run directly into a packaging apparatus to produce finished packages, or in the alternative if desired can be spooled for future use.

Finally, when applying tearstrips to a package, or a reinforcement header strip, or a handle, it is no longer necessary to provide separate materials for the tearstrips, headers, and handles because these materials can be formed directly from the package film itself, thus no longer requiring that supplies of these materials be on hand.

Accordingly, it is a primary object of the invention to provide a novel resealable package and apparatus and method for making resealable packages in which the sealing tape graphics are printed on a part of the film which forms the package body.

Another object of the invention as aforesaid is to provide a novel resealable package and apparatus and method for making resealable packages in which the tape graphics strip is subsequently slit away from the rest of the film and applied to the package as part of the sealing tape.

Still another object of the invention as aforesaid is to provide a novel resealable package and apparatus and method for making resealable packages in which the sealing tape graphics are always perfectly registered with the printing on the body of the package.

A further object of the invention as aforesaid is to provide a novel resealable package and apparatus and method for making resealable packages in which the necessity of having an inventory of preprinted tape is eliminated.

Yet a further object of the invention as aforesaid is to provide a novel resealable package which provides evidence that the package has been opened and apparatus and method for making such resealable packages.

A still further object of the invention as aforesaid is to provide a novel resealable package which provides a hermetic package seal.

Yet another object of the invention is to provide a novel package and apparatus and method for making packages in which tearstrips, headers, and handles can be formed directly from the package film itself.

The foregoing and other objects of the invention will appear more fully hereinafter from a reading of the following specification in conjunction with an examination of the appended drawings.

BRIEF DESCRIPTION OF THE DRAWINGS

FIG. 2 is a cross sectional view through a composite tape which is formed during the package making process and combined with the packaging web material as would be seen when viewed along the line 2—2 on FIG. 1;

FIG. 5 is a diagrammatic showing of an apparatus according to the invention utilizing the composite web of packaging material shown in FIG. 4 for making one form of novel package according to the invention;

FIG. 7 is a diagrammatic showing of an apparatus according to the invention utilizing a variation of the composite web of packaging material shown in FIG. 4 for making a second form of novel package according to the invention;

FIG. 15 is one modified form of the apparatus according to the invention shown in FIG. 1 in which the web edge with which the composite resealable tape is formed is slit from the opposite web edge from that shown in FIG. 1 and is applied to the opposite edge from that shown in FIG. 1;

FIG. 16 is another modified form of the apparatus according to the invention shown in FIG. 1 in which the web edge to which the composite resealable tape is applied is the same edge as that from which the web portion of the composite tape was slit off;

DESCRIPTION OF THE PREFERRED EMBODIMENT

Figure 1:
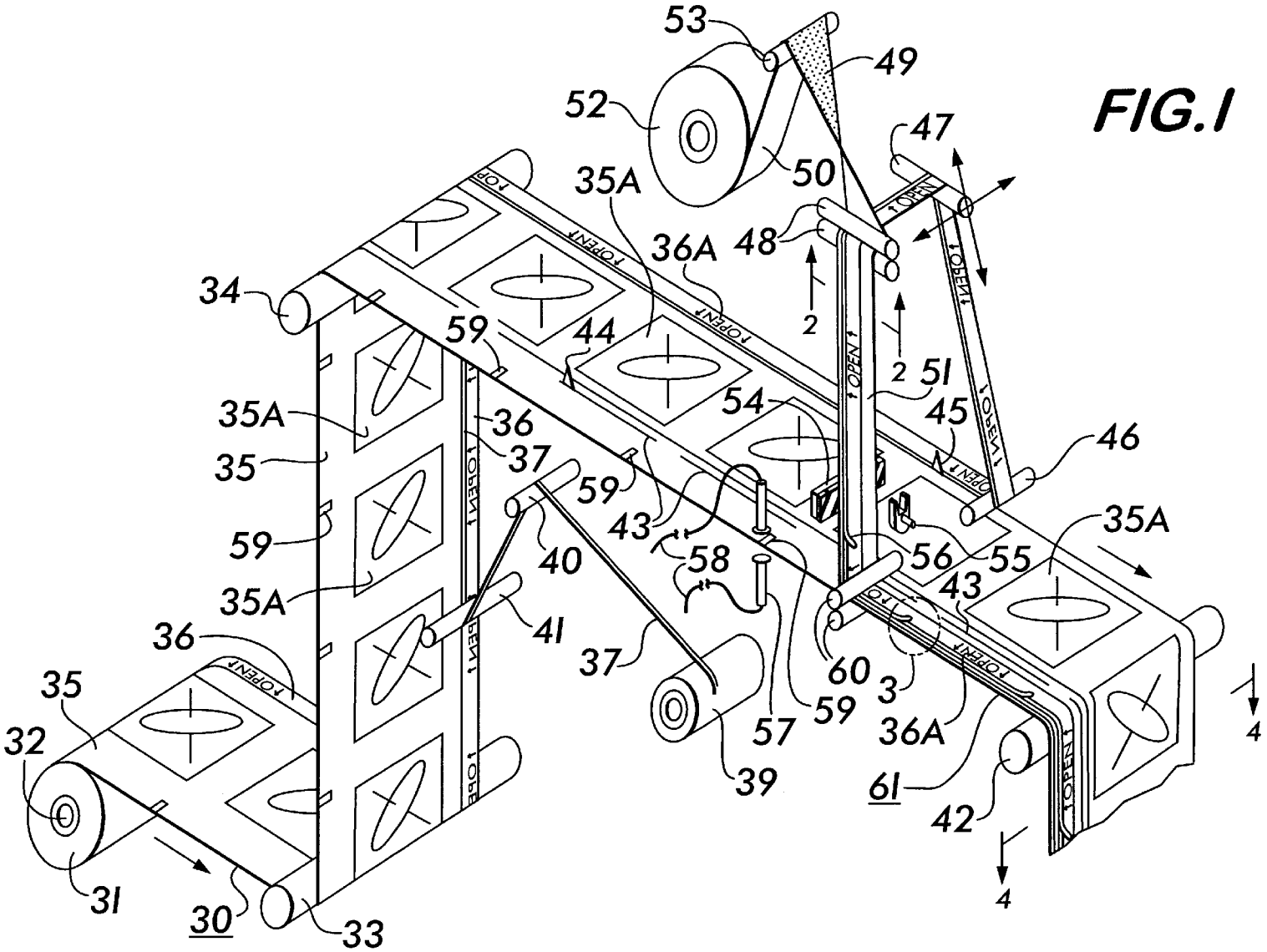
FIG. 1 is an isometric diagrammatic showing of the apparatus according to the invention for making a composite web for producing novel packages according to the invention, the composite web being formable in several configurations by adjustably shifting several components of the apparatus.
Figure 3:
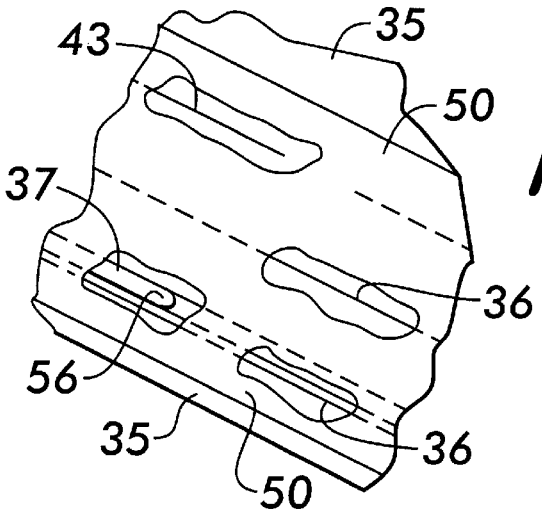
FIG. 3 is an enlarged view of a portion of the composite packaging material web shown in the phantom circle on FIG. 1 showing the tearstrip lift tab.

Considering first the apparatus of FIG. 1 together with the showings of FIGS. 2 and 3, there is seen in diagramatic form the various passive roller devices for controlling the movement through the apparatus of the several components that form the composite web of packaging material. The web is pulled through the apparatus from the right end by a conventionally driven take-up spool or by the feed system of the packaging machines shown in FIGS. 5 and 7, to be subsequently described. As seen in FIG. 1 a supply of preprinted heat sealable packaging film 30 is drawn from the roll 31 carried by the rotatable axle 32, moving to the right and turning upward around roller 33 to the above positioned roller 34 where it turns over the roller and again moves to the right. The web of packaging film 30 has a major widthwise extending region 35 having preprinted running lengths 35A which will ultimately form the individual package bodies, and an edgewise longitudinally extending preprinted strip portion 36 which will form part of the package opener. The graphics on the film strip 36 are printed matched to the graphics on the adjacent package body portions 35A so that when the strip 36 is subsequently separated from the film 30 and then recombined with it, as described hereinafter, the strip graphics can be properly registered with the package.

Figure 13:
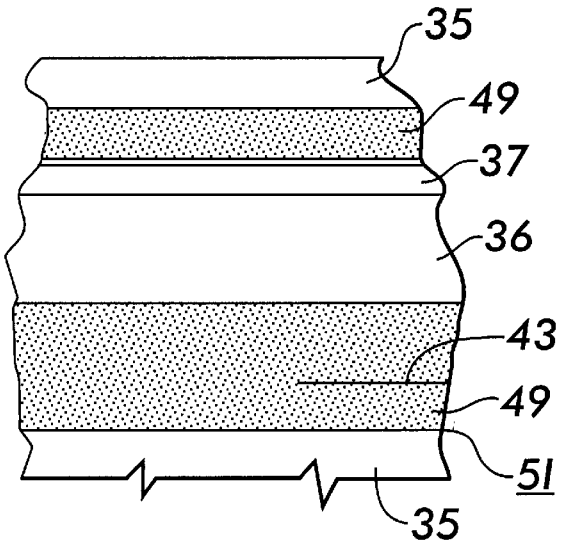
FIG. 13 is a bottom plan view of a section of the longitudinally extending composite web of packaging material shown in the phantom circle on FIG. 12.

A teartape 37 coated on its undersurface with adhesive 38, best seen in FIG. 2, is drawn from a supply roll 39, passing over a tensioning roller 40 and under a pressure roller 41 where the adhesive surface 38 is pressed against and adhered to the film strip portion 36, as also seen in FIGS. 2 and 13. As the film 30 moves to the right between rollers 34 and 42 the rest of the processing takes place which forms the composite web of packaging film. First, the web 30 is intermittently repetitively slit at package body interval lengths, as shown at 43, by a conventional slitting blade device 44 to form the resealable package opening in the completed package. The length of the slits 43 is somewhat shorter than the pagkage length so that in the finished package the slit does not extend into the end heat seals, thereby producing a hermetically sealed package. If a hermetically sealed package is not desired, the slits 43 may be made as a continuous slit.

Next, the film strip portion 36 of the film 30 carrying the teartape 37 is slit away from the package body portion 35 of the film 30 by a conventional slitting blade 45 and is turned upward around roller 46 to above lying adjustably positionable direction changing roller 47 where it is turned transversely to the running direction of the film 30. The roller 47 is vertically and horizontally adjustably positionable in order to control the length of tape 36/37 between the slitting point at blade 45 and the point of combination with the film 30 so that perfect registration between the tape and film graphics is achieved. The adjustability of roller 47 may be dispensed with in a dedicated packaging machine.

Figure 12:
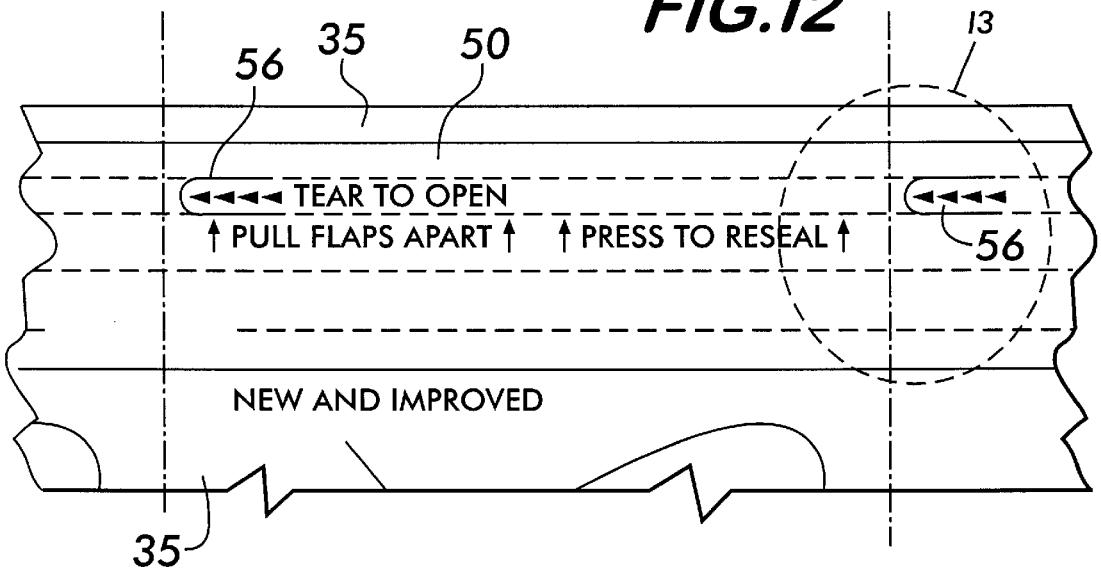
FIG. 12 is a top plan view of a section of the longitudinally extending composite web of packaging material formed by the apparatus of FIG. 1 showing one complete package length and part of the two adjacent package lengths.

The film/teartape strip 36/37 then passes between the pressure rollers 48 where it is adhered to the adhesive surface 49 of transparent tape 50 to form a composite tape structure 51 best seen in FIGS. 2 and 13, the tape 50 being drawn from a supply roll 52, passed over tension roller 53 and turned to present its adhesive face to the film/teartape strip 36/37 as it enters the pressure rollers 48. The composite tape 51 moves downward between a silicone rubber anvil pad 54 and a reciprocable heated nichrome wire tab former 55 of a lift tab forming device which forms the U-shaped teartape lift tab 56 for each package length of the film 30, the lift tab 56 being best seen in the enlarged detail showing of FIGS. 3 and 12. The lift tab forming device could typically be a Tab Former Assembly made by Tearstrip Systems, Inc. of Boyertown, Pa. Actuation of the tab former 55 is controlled by photocell 57 which generates an actuating signal on the leads 58 when it detects a film opacity change as each eye mark 59 on the film 30 reaches it. This same signal can be used to control the the actuation of the slitting blade 44 to make the slits 43, or in a package dedicated machine the blade 44 may be cam controlled.

Figure 4:
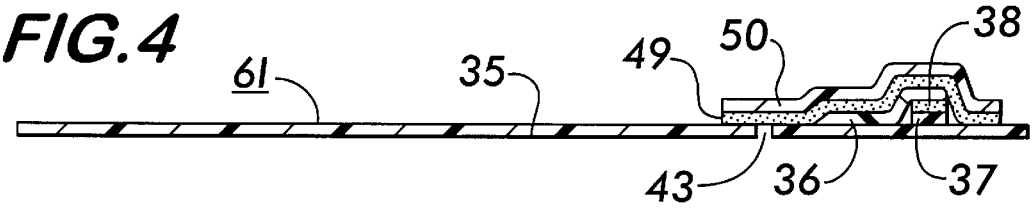
FIG. 4 is a transverse section through a composite web of packaging material produced by the apparatus of FIG. 1 before it enters a packaging apparatus.
Figure 6:
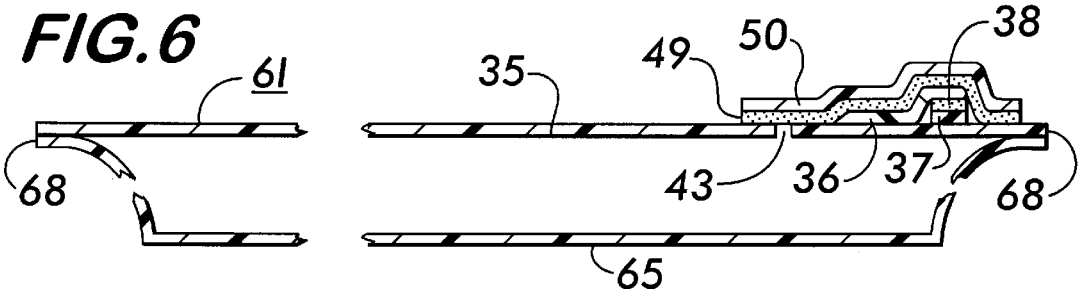
FIG. 6 is a transverse section through the form of package formed from a web of packaging material as produced by the packaging apparatus of FIG. 5.
Figure 8:
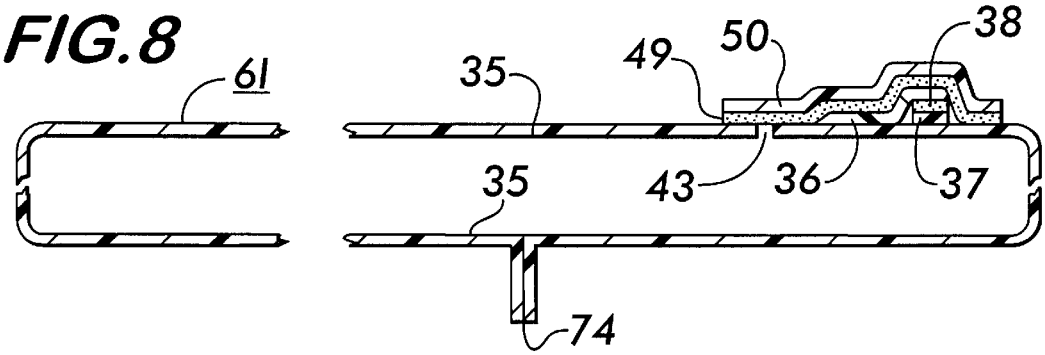
FIG. 8 is a transverse section through the form of package formed from a web of packaging material as produced by the packaging apparatus of FIG. 7.
Figure 19:
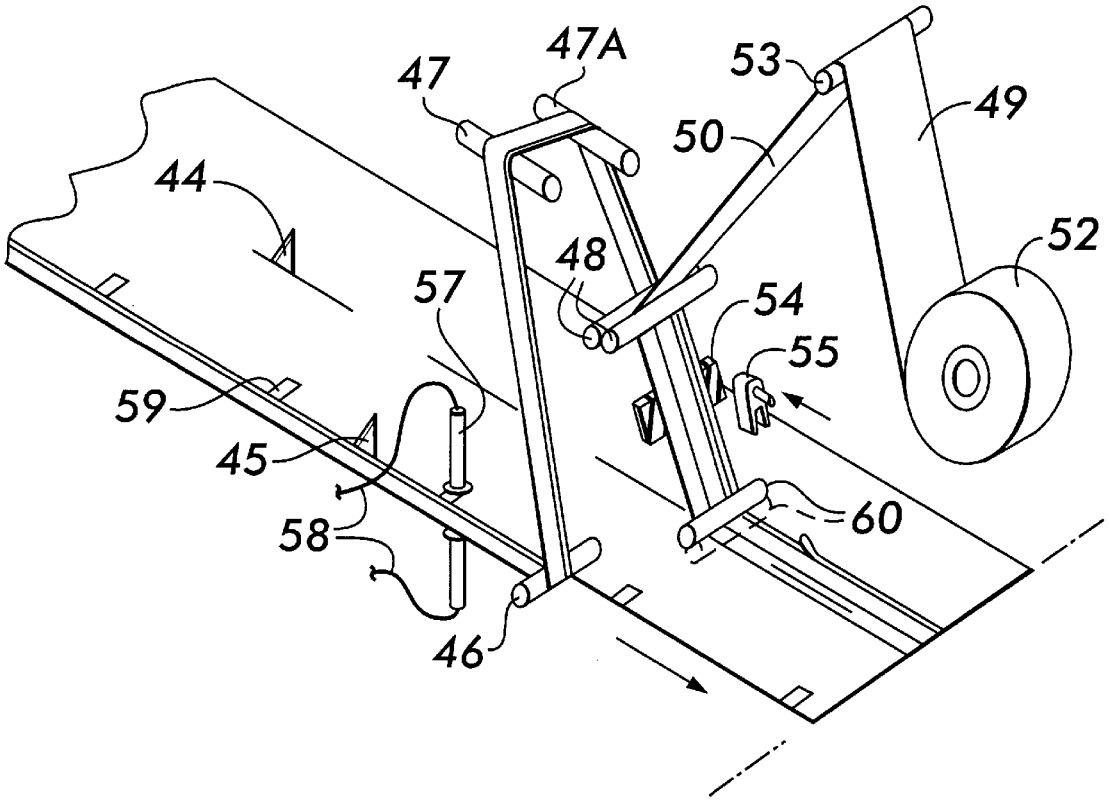
FIG. 19 shows a modification of the apparatus shown in FIG. 15 in which the composite resealable tape is applied to the packaging film along a line lying intermediate and parallel to the film edges.

The composite tape 51 continues downward and between pressure rollers 60 where it turns horizontally into parallel longitudinal registration with the the film 35 and has its adhesive surface 49 pressed against and adhered to the film 35 to form the composite web of packaging material 61 as seen also in the cross section of FIG. 4. While the composite web 61 is shown with the composite tape 51 applied proximate to one particular edge of the film portion 35 to be used in forming packages as shown in FIGS. 5 and 6, it will be understood that the apparatus shown in FIG. 1 can be simply adjusted, as shown in FIG. 16, so that the tape 51 can as well be applied to the edge of film portion 30 from which it was slit to also form packages as shown in FIGS. 5 and 6. Additionally, by apparatus modification as shown in FIG. 19 the tape 51 can be applied longitudinally along a widthwise intermediately lying line of the film portion 35 to form packages as shown in FIGS. 7 and 8. These apparatus adjustments are readily accomplished by positionally adjusting the tab former 54/55, the tape supply 52, the slitting blades 44 and 45, and the rollers 46, 47, 48 and 60 which control the positioning of the tape 51 relative to the film 35. Moreover, while the embodiment of FIG. 1 shows the strip 36 being slit from a particular edge of the film 30, it may if desired be slit from the other edge of the film 30, as shown in FIG. 15, and applied along either edge or at an intermediate position by apparatus adjustments as above described and the shifting of the slitting blade 45 to a position proximate to the other edge of film 30.

Considering now FIG. 5 there is seen a packaging machine, which typically could be a Multivac rollstock packaging machine made by Multivac, Inc. of Kansas City, Mo., which produces a perimetrally sealed package from separate top and bottom webs of heat sealable film with the package contents sealed between the two webs. As shown, the items 62 to be packaged are fed into the packaging machine 63 on a conveyor 64 along with the top composite web 61 and the bottom web 65, which latter may be either plain film or printed as desired. The packaging is carried out in the normal manner, and the packaged products 66 emerge on conveyor 67. The form of package is shown in the cross sectional view of FIG. 6 with the edge seals designated as 68 and without the package contents.

Considering now FIG. 7 there is seen a packaging machine, which typically could be a Horizontal Wrapper packaging machine made by FMC Corporation of Green Bay, Wis., which produces a wrapped and bottom sealed package from a single composite web 61 wrapped about the package contents. As shown, the items 69 to be packaged are fed into the packaging machine 70 on a conveyor 71 along with the top composite web 61. The packaging is carried out in the normal manner, and the packaged products 72 emerge on conveyor 73. The form of package is shown in the cross sectional view of FIG. 8 with the bottom seal designated as 74 and without the package contents.

Figure 9:
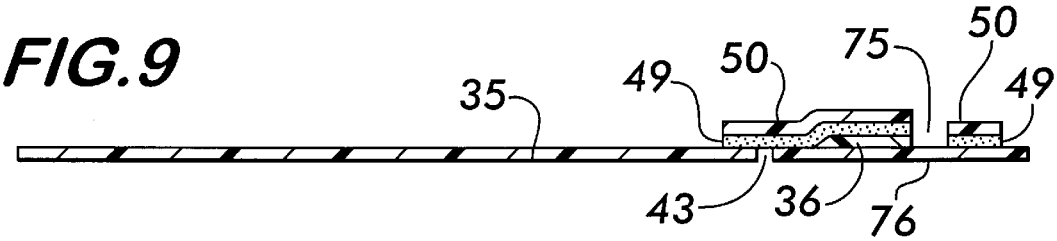
FIG. 9 is a transverse section through any of the forms of package shown with the incorporated tear strip having been torn away.
Figure 10:
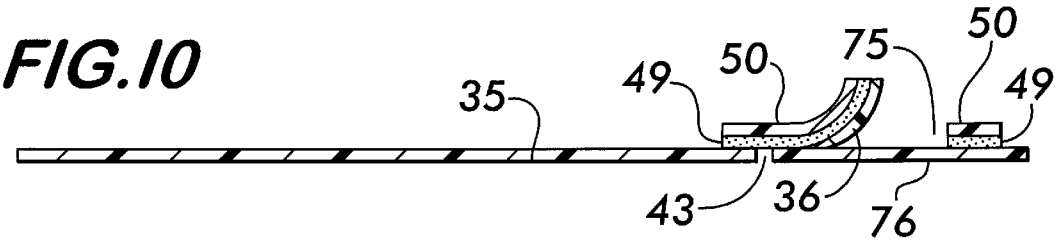
FIG. 10 is a transverse section through any of the forms of package shown with the incorporated tear strip having been torn away and the lift tab turned up but without unsealing and opening the package.
Figure 11:
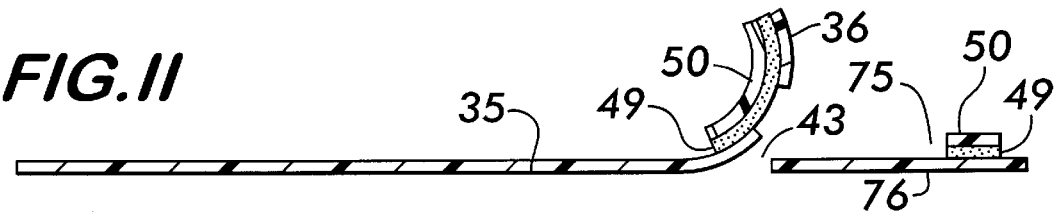
FIG. 11 is a transverse section through any of the forms of package shown with the incorporated tear strip having been torn away and the lift tab lifted to open the package.
Figure 14:
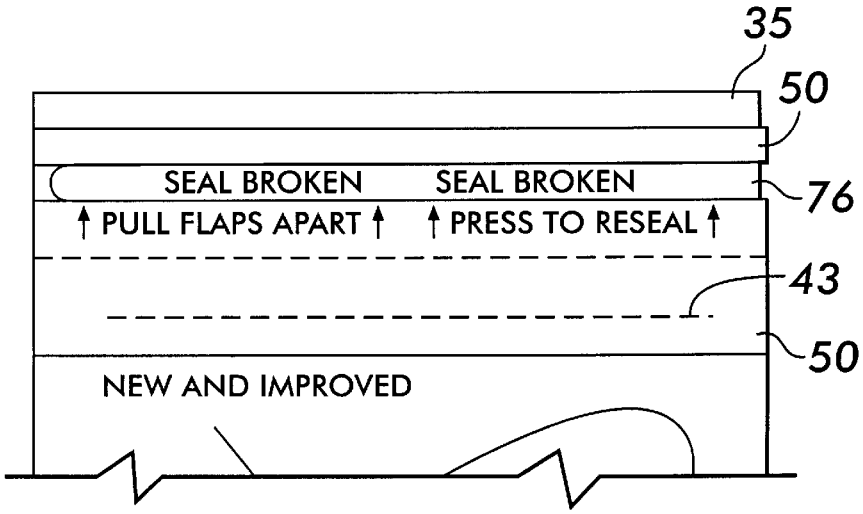
FIG. 14 is a top plan view of a package according to the invention with the tear tape torn away.

Irrespective of which type of package is formed, it is seen from FIGS. 4, 6, and 8 that the tamper evidence resealable package closure is the same without regard to the widthwise location of the composite tape 51. The opening and resealing features of the packages are shown in FIGS. 9, 10, and 11. FIG. 9 shows the teartape 38 having been torn away by grasping the teartape lift tab 56 and tearing the tape away to leave the open channel 75 to expose the underlying part 76 of the film 35 as also seen in FIG. 14, and free the tape strip 36. As seen in FIG. 14 the surface part 76 of film 35 that is disclosed when the teartape 37 is torn away to unseal the package is printed to show that the package seal has been ruptured. Since the tape strip 36 was not adhered to the film portion 35, it together with the adhered portion of tape 50 is finger graspable as a lift tab and liftable away from the surface of film 35, and this is shown in FIG. 10. FIG. 11 shows the lift tab lifted to unseal the the package opening 43 to provide access to the package contents. The package is resealed by merely pressing the lift tab back down against the film 35 so that the adhesive surface 49 of the tape 50 again seals the opening 43.

FIG. 15 illustrates a modified form of the apparatus shown in FIG. 1 in which the web edge with which the composite resealable tape is formed is slit from the opposite web edge from that shown in FIG. 1 and is applied to the opposite edge from that shown in FIG. 1, or if desired as shown in FIG. 19 along a line lying intermediate and parallel to the edges. This is simply accomplished by repositioning of the slitting blades 44, 45, the rollers 46, 47, 48, 53, 60, the tape roll 52, and adding roller 47A.

FIG. 16 shows another modified form of the apparatus shown in FIG. 1 in which the web edge to which the composite resealable tape is applied is the same edge as that from which the web portion of the composite tape was slit off. This is again accomplished by repositioning of the slitting blades and rollers.

Figure 17:
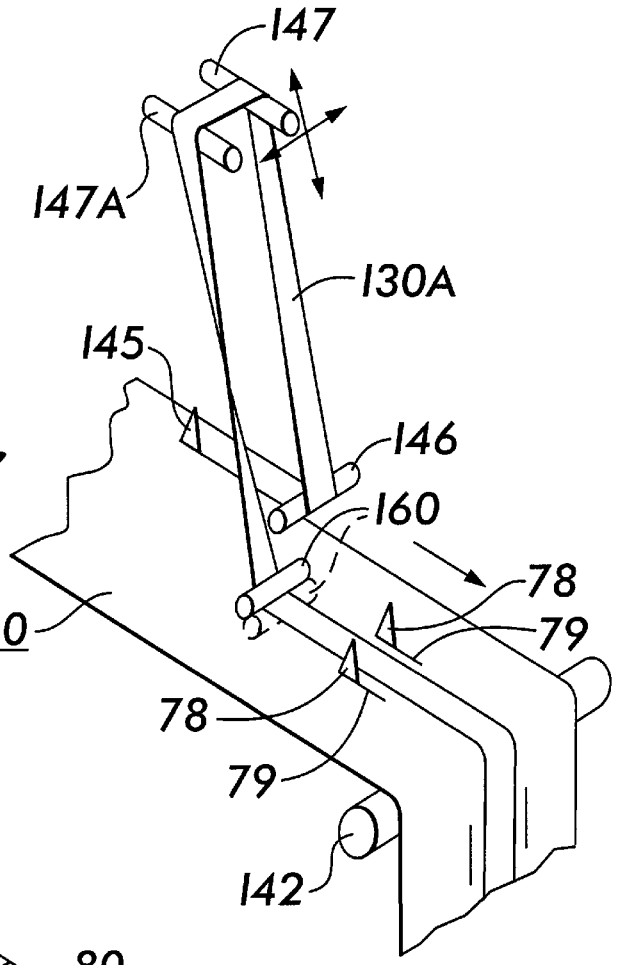
FIG. 17 is another modified form of the apparatus according to the invention shown in FIG. 1 to form an easy-opening non-resealable package in which the the separate teartape shown in FIGS. 1, 15 and 16 is not utilized, and the slit off strip of the web is applied to the package as the teartape.

FIG. 17 shows a form of the apparatus shown in FIG. 1 modified to form an easy-opening non-resealable package in which the separate teartape 37 shown in FIGS. 1, 15 and 16 is not utilized, and the slit off strip of the web is applied to the package as the teartape. The knife 145 slits off the web strip 130A which is turned up around roller 146 and around rollers 147 and 147A back down to the film 130 to which it is adhesively heat sealed by rollers 160. The composite film is package interval slit by knives 78 to form package spaced slits 79, the finished film passing around roller 142 either to a packaging machine or for spooling.

Figure 18:
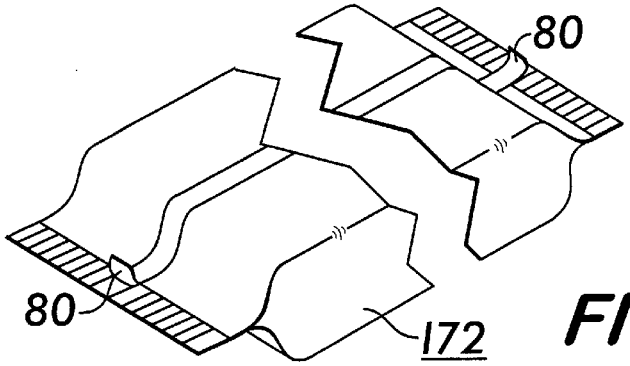
FIG. 18 is an isometric view of a package formed from a web of packaging material as produced by the packaging apparatus of FIG. 17.

FIG. 18 shows a package 172 formed from the composite web of packaging material 130 produced by the apparatus of FIG. 17, and having the tear tabs 80 formed from the strip 130A slit off from the film 130 and the film slits 79. These tabs are formed when the packages sealed ends are transversely cut.

Having now described the invention in connection with particularly illustrated embodiments thereof, variations and modifications of the invention may now naturally occur to those normally skilled in the art without departing from the essential scope and spirit of the invention, and accordingly it is intended to claim the invention broadly as well as specifically as indicated in the appended claims.

What is claimed is:

1. A composite web of flexible packaging material, comprising in combination, a) a web of flexible packaging wrapper material (35) having width and length, b) a separate strip of flexible packaging wrapper material (36), said strip (36) formerly comprising an integral longitudinally extending marginal portion of said web of flexible packaging wrapper material (35) and thereby having the same physical characteristics as said web (35), and c) tape means (50) coated with adhesive means (49) securing said strip (36) to said web (35) along a length of said web (35), said tape means (50) being wider than said strip (36).

2. A composite web of flexible packaging material as set forth in claim 1 wherein said strip (36) is secured to said web (35) along an edge of said web.

3. A composite web of flexible packaging material as set forth in claim 1 wherein said strip (36) is secured to said web (35) along a web width non-adjacent to either edge of said web.

4. A composite web of flexible packaging material as set forth in claim 1 wherein said web of flexible packaging wrapper material (35) and said strip (36) are respectively preprinted with first and second positionally related indicia (35A and 36A), and said strip (36) is secured to said web (35) with said first and second indicia (35A and 36A) secured in predetermined indexed positions with respect to one another.

5. A composite web of flexible packaging material, comprising in combination, a) a web of flexible packaging wrapper material (35) having a longitudinally extending slit (43) for a portion of its length, b) a separate strip of flexible packaging wrapper material (36), said strip (36) formerly comprising an integral longitudinally extending marginal portion of said web of flexible packaging wrapper material (35) and thereby having the same physical characteristics as said web (35), c) a longitudinally extending teartape (37) secured longitudinally to said strip of material (36), and d) means (49/50) securing said strip (36) and teartape (37) to said web (35) along a length of said web adjacent and parallel to said longitudinally extending slit (43) with said teartape (37) positioned between said slit (43) and the proximate marginal edge of said web (35), and with said teartape (37) sandwiched between said strip (36) and web (35).

6. A composite web of flexible packaging material as set forth in claim 5 wherein said means securing said strip to said web is adhesive means.

7. A composite web of flexible packaging material as set forth in claim 5 wherein said means securing said strip to said web is tape means coated at least partially widthwise with adhesive means.

8. A composite web of flexible packaging material as set forth in claim 5 wherein said means securing said strip to said web is tape means wider than said strip and coated at least partially widthwise with adhesive means.

9. A composite web of flexible packaging material as set forth in claim 5 wherein said means securing said strip to said web is tape means wider than said strip and coated at least partially widthwise with adhesive means which extends widthwise beyond both side edges of said strip, said adhesive means extending along one side of said strip overlying and sealing closed said slit in said web.

10. A composite web of flexible packaging material as set forth in claim 5 wherein said means securing said strip to said web is tape means wider than said strip and coated at least partially widthwise with adhesive means, the width of said adhesive means being wider than said strip.

11. A composite web of flexible packaging material as set forth in claim 5 wherein said web of flexible packaging wrapper material (35) and said strip (36) are respectively preprinted with first and second positionally related indicia (35A and 36A), and said strip (36) is secured to said web (35) with said first and second indicia (35A and 36A) secured in predetermined indexed positions with respect to one another.

12. A composite web of flexible packaging material as set forth in claim 5 wherein said means (49/50) securing said strip (36) to said web (35) is adhesive means, and said strip (36) is secured to said web (35) along an edge of said web (35).

13. A composite web of flexible packaging material as set forth in claim 5 wherein said means (49/50) securing said strip (36) to said web (35) is adhesive means, and said strip (36) is secured to said web (35) along a web width non-adjacent to either edge of said web.

14. A composite web of flexible packaging material as set forth in claim 9 wherein said strip (36) is secured to said web (35) along an edge of said web.

15. A composite web of flexible packaging material as set forth in claim 9 wherein said strip (36) is secured to said web (35) along a web width non-adjacent to either edge of said web.

16. A composite web of flexible packaging material as set forth in claim 9 wherein said web of flexible packaging wrapper material (35) and said strip (36) are respectively preprinted with first and second positionally related indicia (35A and 36A), and said strip (36) is secured to said web (35) with said first and second indicia (35A and 36A) secured in predetermined indexed positions with respect to one another.

17. A composite web of flexible packaging material as set forth in claim 10 wherein said web of flexible packaging wrapper material (35) and said strip (36) are respectively preprinted with first and second positionally related indicia (35A and 36A), and said strip (36) is secured to said web (35) with said first and second indicia (35A and 36A) secured in predetermined indexed positions with respect to one another.

* * * * *